US010641135B2

(12) United States Patent
Weidauer et al.

(10) Patent No.: US 10,641,135 B2
(45) Date of Patent: May 5, 2020

(54) METHOD FOR PRODUCING A CAM PROFILE OF A CAM PACK OF A CAMSHAFT

(71) Applicant: ThyssenKrupp Presta TecCenter AG, Eschen (LI)

(72) Inventors: Marcel Weidauer, Chemnitz (DE); Bernd Mann, Zschopau (DE); Mario Lindner, Chemnitz (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 267 days.

(21) Appl. No.: 15/537,709

(22) PCT Filed: Oct. 6, 2015

(86) PCT No.: PCT/EP2015/073042
§ 371 (c)(1),
(2) Date: Jun. 19, 2017

(87) PCT Pub. No.: WO2016/096181
PCT Pub. Date: Jun. 23, 2016

(65) Prior Publication Data

US 2018/0003087 A1 Jan. 4, 2018

(30) Foreign Application Priority Data

Dec. 19, 2014 (DE) ..... 10 2014 018 784

(51) Int. Cl.
*F01L 1/047* (2006.01)
*F01L 1/08* (2006.01)
(Continued)

(52) U.S. Cl.
CPC ..... *F01L 1/047* (2013.01); *F01L 1/08* (2013.01); *F01L 1/34413* (2013.01);
(Continued)

(58) Field of Classification Search
CPC ..... F01L 1/047; F01L 1/34413; F01L 1/08; F01L 13/0057; F01L 2103/00; F01L 2001/0473; B24B 19/12
See application file for complete search history.

(56) References Cited

U.S. PATENT DOCUMENTS 3,999,277 A * 12/1976 Hamada ..... F16D 1/06 29/447
4,269,551 A * 5/1981 Kralowetz ..... B23C 3/06 29/888.08
(Continued)

FOREIGN PATENT DOCUMENTS

DE 19914909 A 10/2000
DE 10038916 A 2/2002
(Continued)

OTHER PUBLICATIONS

English translation of International Search Report issued in PCT/EP2015/073042, dated Feb. 8, 2016 (dated Feb. 15, 2016).
(Continued)

*Primary Examiner* — Rick K Chang
(74) *Attorney, Agent, or Firm* — thyssenkrupp North America, LLC.

(57) ABSTRACT

A method concerns producing a cam profile of a cam pack with at least two cam elements that can be adjusted relative to each other. The camshaft may comprise an outer shaft, a rotatable inner shaft, a fixed cam element connected to the outer shaft, and an adjustment cam element connected to the inner shaft. The method may comprise processing an adjustment cam contour by a continuous diameter reduction of a segment of the adjustment cam base circle, wherein the adjustment cam base circle is reduced to a diameter that is smaller than a fixed cam nominal circle diameter minus a doubled adjustment cam base circle tolerance. The method may comprise processing a fixed cam contour by reducing a
(Continued)

fixed cam contour protrusion in a region between a transition point and a processing point. Upon reaching the transition point a tapping element for converting a revolving motion of the cam elements into a linear motion of the valves is transferred from the fixed cam element to the adjustment cam element.

6 Claims, 6 Drawing Sheets

(51) Int. Cl.
*F01L 13/00* (2006.01)
*F01L 1/344* (2006.01)
*B24B 19/12* (2006.01)

(52) U.S. Cl.
CPC ..... *F01L 13/0057* (2013.01); *B24B 19/12* (2013.01); *F01L 2001/0473* (2013.01); *F01L 2103/00* (2013.01)

(56) References Cited

U.S. PATENT DOCUMENTS 4,312,154 A * 1/1982 Fournier ..... B24B 19/12 451/239
4,747,236 A * 5/1988 Wedeniwski ..... B24B 19/12 409/104
4,833,834 A * 5/1989 Patterson ..... B24B 19/12 451/239
5,129,407 A 7/1992 Phillips
5,392,566 A * 2/1995 Wedeniwski ..... B24B 19/12 451/11
5,562,523 A * 10/1996 Asano ..... B24B 49/04 451/1
5,862,783 A 1/1999 Lewis
5,899,797 A * 5/1999 Junker ..... B24B 19/12 451/242
6,182,362 B1 2/2001 Lancefield
6,470,775 B1 * 10/2002 Kohlhase ..... B23B 5/18 29/6.01
6,742,252 B1 * 6/2004 Santorius ..... B23P 13/00 29/558
7,413,498 B2 * 8/2008 Omata ..... B24B 5/42 451/303
8,517,804 B2 * 8/2013 Weigmann ..... B24B 21/02 451/303
8,677,620 B2 * 3/2014 Furchheim ..... B21D 53/845 29/888.1
8,701,609 B2 * 4/2014 Wahl ..... F01L 1/053 123/90.16
9,050,701 B2 * 6/2015 Yamaguchi ..... B24B 1/00
9,217,340 B2 * 12/2015 Moon ..... F01L 13/0042
9,261,177 B2 * 2/2016 Binder ..... B21D 53/845
2004/0166767 A1 * 8/2004 Hasegawa ..... B24B 5/42 451/5
2004/0166776 A1 * 8/2004 Kondo ..... B24B 5/42 451/28
2009/0223049 A1 9/2009 Binder

FOREIGN PATENT DOCUMENTS

DE 10333916 A 3/2005
DE 102006008532 A 8/2007
DE 102006044010 A 11/2007
JP 2006144799 A 6/2006
JP 2008509013 A 3/2008
WO 2012054434 A 4/2012

OTHER PUBLICATIONS

English abstract of DE10333916A.
English abstract of DE102006044010A.

* cited by examiner

METHOD FOR PRODUCING A CAM PROFILE OF A CAM PACK OF A CAMSHAFT

CROSS REFERENCE TO RELATED APPLICATIONS

This application is a U.S. National Stage Entry of International Patent Application Serial Number PCT/EP2015/073042, filed Oct. 6, 2015, which claims priority to German Patent Application No. DE 10 2014 018 784.5 filed Dec. 19, 2014, the entire contents of both of which are incorporated herein by reference.

FIELD

The present disclosure generally relates to camshafts and, more particularly, to cam profiles and methods for producing such cam profiles for camshafts.

BACKGROUND

The use of camshafts is basically known in automotive engineering, by means of which camshafts a rotary motion can be converted into a longitudinal motion in order to operate intake valves and/or outlet valves of a combustion engine. These advantageously constructed camshafts comprise, for example, an outer shaft and an inner shaft arranged concentrically—in particular, coaxially—within the outer shaft in such a way that the inner shaft can be rotated, and at least one fixed cam element connected to the outer shaft for conjoint rotation and one adjustment cam element connected to the inner shaft for conjoint rotation. It is, further, basically known that at least some of these cam elements are ground and possibly also cured after the mounting of the camshaft.

Such a method for grinding cam elements is, for example, described in DE 10 2006 044 010 A1, which focuses on preventing an ingress of grinding dust into the camshaft—in particular, into an intermediate space between the outer shaft and the inner shaft—during the grinding process. For this purpose, a fluid, such as gas or oil, which acts as a barrier fluid, is pressed into the outer shaft under pressure. Particularly during the grinding process of the cam elements, manufacturing tolerances of the individual cam elements exist, wherein a play arising between the cam elements during their mounting onto the outer shaft or the inner shaft can also occur. These deviations bring about an undesired valve travel. In the cited publication, the processing—in particular, the grinding of the contour of the individual cam elements with respect to a desired cam profile—is not described. Rather, the topic of producing an advantageous cam profile in the individual cam elements, in order to allow for a cam profile of the cam pack that satisfies the required specifications, is omitted.

DETAILED DESCRIPTION

Figure 1:
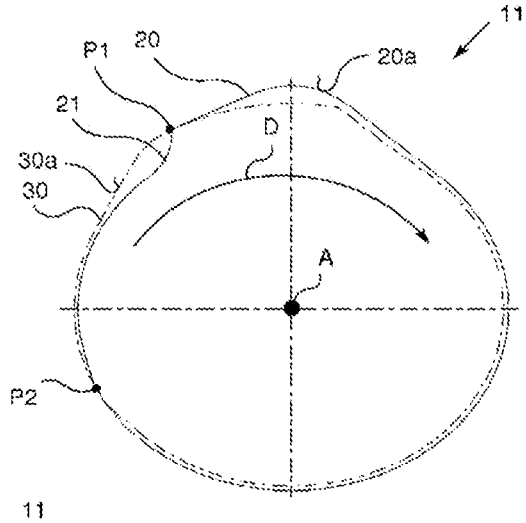
PRIOR ART Fig. 1
FIG. 1 is a side view of a prior art cam pack in a 0° spread.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to a method for producing a cam profile of a cam pack of a cam-shaft. The cam pack may in some examples have at least two cam elements that can be adjusted relative to each other. The present disclosure further relates to a camshaft, in particular, a rotatable camshaft. The rotatable camshaft may include at least one cam pack comprising at least two cam elements that can be adjusted relative to each other.

It is therefore the aim of the present invention to at least partially eliminate the disadvantages described above in a method for grinding cam elements in order to produce a cam contour. It is, in particular, the aim of the present invention to provide a method for producing a cam profile of an adjustable camshaft with an expandable cam pack, as well as a corresponding camshaft with at least one expandable cam pack, by means of which the occurrence of profile jumps is avoided during the contact change of a tapping element between the individual cam elements.

The aforementioned aim is achieved by a method for producing a cam profile of a cam pack of a camshaft, said cam pack having at least two cam elements that can be adjusted in relation to each other, wherein the camshaft comprises an outer shaft and an inner shaft arranged concentrically—in particular, coaxially—within the outer shaft in such a way that the inner shaft can be rotated, and at least one fixed cam element connected to the outer shaft for conjoint rotation and one adjustment cam element connected to the inner shaft for conjoint rotation, having the features according to claim 1. The aforementioned aim is further achieved by a camshaft comprising at least one outer shaft and one inner shaft arranged concentrically—in particular, coaxially—within the outer shaft, and a cam pack with at least one fixed cam element connected to the outer shaft for conjoint rotation and at least one adjustment cam element mounted rotatably in relation to the outer shaft and connected to the inner shaft for conjoint rotation, wherein the adjustment cam element and the fixed cam element can be rotated in relation to each other about a common central axis and together form a cam profile, which interacts with a tapping element for converting a revolving motion of the cam pack into a linear motion of valves, having the features according to claim 6. Additional features and details of the invention result from the dependent claims, description, and drawings. In this respect, features and details described in the context of the method according to the invention naturally also apply in connection with the camshaft according to the invention, and vice versa, so that mutual reference always is or can be made with respect to the disclosure of the individual aspects of the invention. In addition, the camshaft according to the invention—in particular, the cam profile of the cam pack of the camshaft according to the invention—can be produced with the method according to the invention.

The method according to the invention for producing a cam profile of a cam pack of a camshaft, said cam pack comprising at least two cam elements that can be adjusted in relation to each other, wherein the camshaft comprises an outer shaft and an inner shaft arranged concentrically within the outer shaft in such a way that the inner shaft can be rotated, and at least one fixed cam element connected to the outer shaft for conjoint rotation and one adjustment cam element connected to the inner shaft for conjoint rotation, comprises at least the following steps:

Processing an adjustment cam contour of the adjustment cam element by means of the continuous diameter reduction of at least one segment of the adjustment cam base circle, wherein the adjustment cam base circle is reduced to a diameter that is smaller than a fixed cam nominal circle diameter minus a doubled adjustment cam base circle tolerance, and Processing a fixed cam contour of the fixed cam element by reducing a fixed cam contour protrusion of a fixed cam elevation segment at least in a region between a transition point, upon the reaching of which a tapping element for converting a revolving motion of the cam elements into a linear motion of the valve pistons is transferred from the fixed cam element to the adjustment cam element, and a processing point.

Advantageously, a processing of the cam elements by means of the method according to the invention allows for producing a cam profile in an assembled condition of the camshaft. During the processing of the cam pack—in particular, of individual cam elements—the adjustment cam is advantageously arranged rotatably, which means that it is not connected to the inner shaft for conjoint rotation, in order to ensure a spreading apart of the adjustment cam element toward the fixed cam element at least during the processing operation. Based upon the aforementioned processing of the adjustment cam element and the fixed cam element, jumps in the cam profile of the cam pack can be avoided, which jumps arise, for example, as a result of the functionally required play between the adjustment cam element and the outer shaft and the specific cam profiles required for the grinding process, and which jumps present themselves under the load of the camshaft by a strong acceleration occurring, for example, in the valve train during the transfer of the tapping element from the adjustment cam element to the fixed cam element or from the fixed cam element to the adjustment cam element. In addition, such profile jumps also bring about increased wear of the individual components, i.e., for example, of the tapping element or also of the cam elements and, in particular, of the cam element contour, etc.

In the adjustable camshaft, the outer shaft, which, for example, has the form of a hollow shaft, and the inner shaft, which is, for example, designed in form of a solid shaft, are arranged concentrically or coaxially in relation to each other so that the inner shaft extends through the outer shaft at least in sections. The cam pack advantageously consists of at least one fixed cam element and at least one adjustment cam element, which, as described above, are arranged for conjoint rotation with the outer shaft or the inner shaft, and movably in relation to one another, or rotatably about their common axis of rotation. The fixed cam element can therefore be steplessly spread apart in a defined angular range in relation to the adjustment cam element. It is, however, also conceivable for the cam pack to comprise more than two cam elements.

Advantageously, in the cam contour, the leading profile edge or profile flank is formed by means of the fixed cam element, and the trailing profile edge or profile flank is formed by means of the adjustment cam element. This means that the tapping element, which is, for example, a cam follower, such as a roller cam follower, contacts the fixed cam element if the tapping element is in contact with the region of the leading profile edge or profile flank. The tapping element contacts the adjustment cam element as soon as it is in the region of the trailing profile edge. Advantageously, the tapping element contacts the adjustment cam element in the region of the trailing flank shortly after passing over the cam tip.

The profile of the cam pack, which profile is to be formed or produced, advantageously comprises two transition points. At least in the regions of these transition points, a transfer of the tapping element from the fixed cam element to the adjustment cam element takes place, wherein this transition point is called the first transition point within the scope of the invention, or from the adjustment cam element to the fixed cam element, wherein this transition point is called the second transition point within the scope of the invention. Within the scope of the invention, the first transition point is advantageously formed in a region on the profile of the cam pack, which region extends between the beginning of the fixed cam elevation or the adjustment cam elevation and the end of the respective cam elevation, i.e., the adjustment cam elevation or the fixed cam elevation. The second transition point is advantageously formed in a region at the end of the fixed cam elevation or the adjustment cam elevation.

The processing point, which results from the processing of the fixed cam profile, is advantageously formed in the region of the base circle of the fixed cam element—preferably shifted a few angular degrees toward the end of the fixed cam elevation and, consequently, toward the second transition point formed with respect to the basically-known fixed cam elements. This means that the processing point is advantageously formed or shifted in comparison to the basically-known fixed cam elements such that the second transition point formed by means of the processing point is shifted into the fixed cam base circle region. Accordingly, the processing point advantageously forms the second transition point (new transition point), which marks the border region between the fixed cam elevation and the fixed cam base circle. The advantage thereof consists, in particular, in that a correspondingly small region of the base circle of the cam pack, which base circle is to be traversed by the tapping element, must be formed by means of the adjustment cam element—in particular, the adjustment cam base circle.

Within the scope of the invention, the term "base circle," such as the fixed cam base circle or the adjustment cam base circle, refers to a region of the cam element, which extends, when viewed in the circumferential direction of the cam element, between the end of the cam elevation, i.e., the fixed cam elevation or the adjustment cam element, and the beginning of the respective cam elevation, wherein the first transition point is not formed in this named circumferential segment or cam contour region. The first transition point is advantageously formed in the region of the cam elevation, i.e., the cam contour segment in which the cam element has an elevation starting from the axis of rotation of the cam element.

According to the invention, the contour of the fixed cam element—in particular, a protrusion of this contour—advantageously a convex protrusion or a contour elevation of the fixed cam element—is reduced at least in a defined region. This means that at least some radii, which extend in this region of reduction of the contour protrusion, starting from a central point of the fixed cam element, radially outward, are at least partially reduced or decreased.

When using the method according to the invention, the camshaft—in particular, the cam elements—is therefore advantageously ground in a mounted condition. In this respect, it is conceivable that the adjustment cam element arranged rotatably in relation to the inner shaft and/or the outer shaft is spread apart from the fixed cam element connected to the outer shaft for conjoint rotation and is advantageously arrested—in particular, during the processing operation of the fixed cam contour. The inner shaft itself can—but does not need to—be mounted or arranged within the outer shaft during the processing of the cam elements. It is, additionally, also conceivable for the adjustment cam contour of the adjustment cam element to have already been processed—in particular, ground—prior to the mounting of the camshaft, so that the adjustment cam element is mounted onto the outer shaft in the processed condition, while the fixed cam element is processed after the mounting of the camshaft. It would, however, also be conceivable for both cam elements to be processed prior to the mounting and to thus be mounted onto the outer shaft in the ground condition. It is, consequently, also possible for both cam elements not to be processed until after the mounting of the camshaft and for their contours to accordingly be ground to form a cam profile avoiding profile jumps.

Within the scope of the invention, it is therefore conceivable that the processing of at least the adjustment cam contour or the fixed cam contour take place by means of a grinding process. In this respect, it is conceivable for the adjustment cam element to be spread apart from the fixed cam element and positioned on the outer shaft during the processing of the fixed cam contour and arrested, for example, such that the fixed cam element and, in particular, the contour of the fixed cam element can be processed. Advantageously, in the processing—in particular, the grinding process—the fixed cam element is processed in the transition region between the fixed cam elevation and the fixed cam base circle. Advantageously, material is removed in this region from the circumference of the fixed cam element.

Within the scope of the invention, it is conceivable that the adjustment cam contour be designed as a constant cam elevation at least one of the transition points. This constant adjustment cam contour advantageously extends in the region of the first transition point, where the tapping element is transferred from the fixed cam element to the adjustment cam element. A constant adjustment cam contour is understood in this respect to mean a region of the cam elevation of the fixed cam element, which region has no positive and/or negative slope. The adjustment cam contour is advantageously designed in this case such that, taking into consideration the desired adjustment angle, the adjustment cam profile of the adjustment cam element, when spread 0°, is covered by the fixed cam profile of the fixed cam element. It would also be conceivable that, instead of or in addition to forming a constant cam elevation in the adjustment cam element as described above, a correspondingly comparably-designed constant cam elevation be formed in the fixed cam element.

It is further conceivable that the adjustment cam contour of the adjustment cam element be reduced in the adjustment cam base circle at least in sections by about 0.02 mm per about 5° cam angle. This advantageously results in a continuous diameter reduction of the adjustment cam element. The adjustment cam profile, consequently, advantageously decreases starting from the second transition point down to the adjustment cam base circle, which, when viewed in relation to the fixed cam base circle, has a smaller diameter and is, consequently, advantageously formed in the form of a recess.

As a result, a recess is advantageously produced at least in sections in the adjustment cam base circle of the adjustment cam contour, which recess is reduced in relation to the fixed cam base circle at least by about a doubled profile tolerance of the adjustment cam base circle. This, advantageously, makes it possible for the cam tap in the base circle to be formed by means of the fixed cam element. This means that the tapping element explicitly contacts the fixed cam base circle only when traversing the base circle region of the cam pack.

According to a second aspect of the invention, a camshaft according to the invention comprises at least one outer shaft and one inner shaft arranged concentrically or coaxially within the outer shaft, and a cam pack with at least one fixed cam element connected to the outer shaft for conjoint rotation and at least one adjustment cam element mounted rotatably in relation to the outer shaft and connected to the inner shaft for conjoint rotation, wherein the adjustment cam element and the fixed cam element can be rotated in relation to each other about a common central axis and form a common cam profile, which interacts with a tapping element for converting a revolving motion of the cam pack into a linear motion of valve pistons. According to the invention, the cam profile has an adjustment cam contour of the adjustment cam element with an adjustment cam base circle diameter reduced at least in sections, which diameter is smaller than a fixed cam nominal circle diameter minus a doubled adjustment cam base circle tolerance, and a fixed cam contour of the fixed cam element with a fixed cam contour protrusion reduced at least in sections in at least one region between a first of at least two transition points, upon the reaching of which the tapping element can be transferred from the fixed cam element to the adjustment cam element, and a processing point, which is arranged at least in sections in the fixed cam base circle.

The camshaft can also comprise one or more cam packs with more than two cam elements and, in particular, three and more cam elements, wherein at least one of the cam packs comprises a fixed cam element and an adjustment cam element of the aforementioned design.

Within the scope of the invention, the nominal circle diameter is understood to be an ideal, mathematically calculable diameter of the processed cam element.

According to the invention, the adjustment cam comprises an adjustment cam base circle extending between the end of the adjustment cam elevation and the beginning of the adjustment cam elevation. The diameter of the adjustment cam base circle is advantageously less than the fixed cam base circle of the fixed cam element, which fixed cam base circle also extends between the end of the fixed cam elevation and the beginning of the fixed cam elevation. Accordingly, the adjustment cam element advantageously comprises, at least in sections, a recess in the region of the adjustment cam base circle, which recess is reduced at least by the doubled profile tolerance of the adjustment cam base circle in comparison to the fixed cam base circle.

It is furthermore conceivable that, at least at one of the transition points, the fixed cam contour have a constant cam elevation. Advantageously, this constant cam elevation is formed in the region of a first transition point, where the tapping element can be transferred from the fixed cam contour to the adjustment cam contour, and has, particularly advantageously, no—or a negligibly small—positive and/or negative slope. It is also conceivable that the adjustment cam element have a segment with a constant cam elevation, wherein this constant cam elevation advantageously extends in the region of the first transition point. It is advantageously also possible that both cam elements respectively have a segment with a constant cam elevation, wherein the constant cam elevations are, respectively, particularly advantageously formed in the region of the first transition point. Both constant cam elevation segments can in this case have an identical or a different design with respect to each other—for example, with respect to the length in the circumferential direction and/or with respect to the starting and/or end point, etc.

It is advantageously conceivable that the camshaft according to the invention be produced or manufactured using the method described in the first aspect of the invention. Accordingly, the contours of the individual cam elements, and consequently the profile of the entire cam pack, are advantageously produced using the aforementioned method.

All the advantages already described with respect to a method for producing a cam profile according to the first aspect of the invention result in the camshaft described.

Embodiments of the cam pack of a camshaft according to the invention—in particular, of the fixed cam element and the adjustment cam element—and embodiments of basically-known cam packs—in particular, their fixed cam elements and their adjustment cam elements—are explained in more detail below with reference to the drawings.

Elements with the same function and mode of operation are respectively provided with the same reference symbols in FIGS. 1 through 13.

Figure 2:
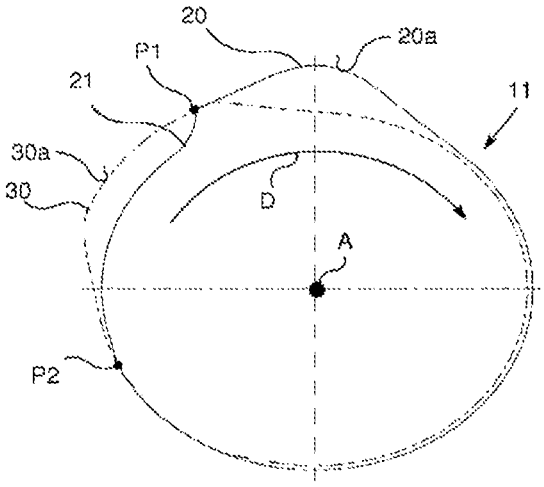
PRIOR ART Fig. 2
FIG. 2 is a side view of the prior art cam pack shown in FIG. 1 in a maximum spread.
Figure 3:
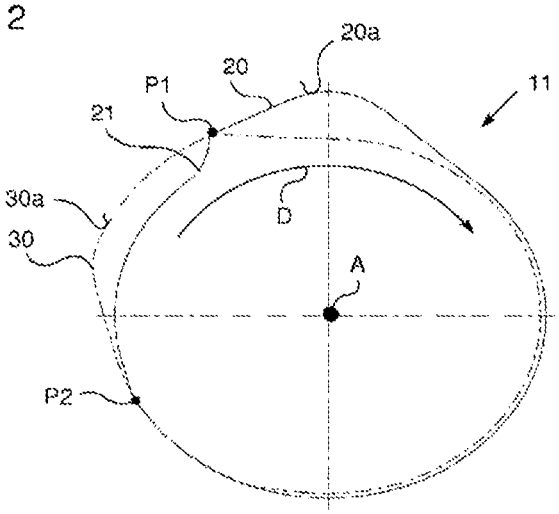
PRIOR ART Fig. 3
FIG. 3 is a side view of the prior art cam pack shown in FIGS. 1-2 in a grinding position.

FIGS. 1 through 3 respectively show a lateral view of an embodiment of a basically-known cam pack 11. The cam pack 11 comprises at least one fixed cam element 20 with a basically-known fixed cam contour 20*a* and one adjustment cam element 30 with a basically-known adjustment cam contour 30*a*. In FIG. 1, the cam pack 11 is in a 0° spread position, while, in FIG. 2, this cam pack 11 is in a maximum spread position. This means that the adjustment cam element 30 is spread apart or turned in relation to the fixed cam element 20, wherein, therefore, taking into consideration the requirements and load conditions of the combustion engine of a motor vehicle, such angular positions between the adjustment cam element 30 and the fixed cam element 20 can, advantageously, be taken steplessly. Within the scope of the invention, "stepless" is understood to mean that any angular position between the aforementioned spread positions can be taken. The cam profile of the cam pack 11 is composed of several segments and is, consequently, advantageously formed by means of the fixed cam contour 20*a* and the adjustment cam contour 30*a*. The contact between the individual cam elements 20 or 30 of the cam pack 11 and a tapping element, which is not shown here and which, for example, is designed in the shape of a cam follower, advantageously switches between the fixed cam element 20 and the adjustment cam element 30 with each rotation of the camshaft and, consequently, of the cam pack 11—in particular, of the individual cam elements 20, 30—about a central axis of rotation A in the direction of rotation D.

As can be seen in FIGS. 1 and 2, the transition point P1, which is, advantageously, a calculated and therefore a theoretical transition point, where the tapping element (not shown here) is transferred from the fixed cam element 20 to the adjustment cam element 30, is theoretically most often located in a transition region of the fixed cam element 20. Within the scope of the invention, the transition region of the fixed cam element 20 defines a region of the contour of the fixed cam element 20, in which a recess 21 starts in the region of the fixed cam elevation, wherein the recess 21 extends along a segment of the fixed cam contour—advantageously, up to the second transition point P2. In particular, in the transition region, an abrupt decrease of the fixed cam contour 20*a* is formed, in order to produce the recess 21. The cam elements 20 and 30 shown in FIGS. 1 through 3 are processed or ground jointly in a known manner, wherein, to this end, the camshaft itself is in a mounted condition provided for this purpose. During the grinding process for producing the cam contour 20*a* or 30*a* of the individual cam elements 20 or 30, the inner shaft (not shown here) bends as a result of the load of the grinding wheel (not shown here), which load acts upon the cam elements 20 or 30—in particular, upon the adjustment cam element 30. As a result, an undesired displacement of the adjustment cam element 30 occurs, whereby, in turn, disadvantageous profile jumps in the cam profile—in particular, in the regions of the transition points P1 or P2—are produced. At the transition point P2, the tapping element is advantageously transferred again from the adjustment cam element 30 to the fixed cam element 20. Such profile jumps result in undesired—in particular, impermissible—accelerations in the valve train and must therefore be avoided. In particular, the design of the recess 21 in the fixed cam element 20, which is required because of the common grinding process of the cam elements 20 or 30, is, advantageously, to be used so that a reliable transfer between the fixed cam element 20 and the adjustment cam element 30 takes place and positively determines such profile jumps.

FIG. 3 shows a lateral view of the embodiment, shown in FIGS. 1 and 2, of a basically-known cam pack 11 in a grinding position. In such a position of the cam pack 11, in which the adjustment cam element 30 is spread apart in relation to the fixed cam element 20 at a predefined angle, a processing of at least one of the cam contours 20*a* or 30*a* of the cam elements 20 or 30 is, advantageously, made possible.

Figure 4:
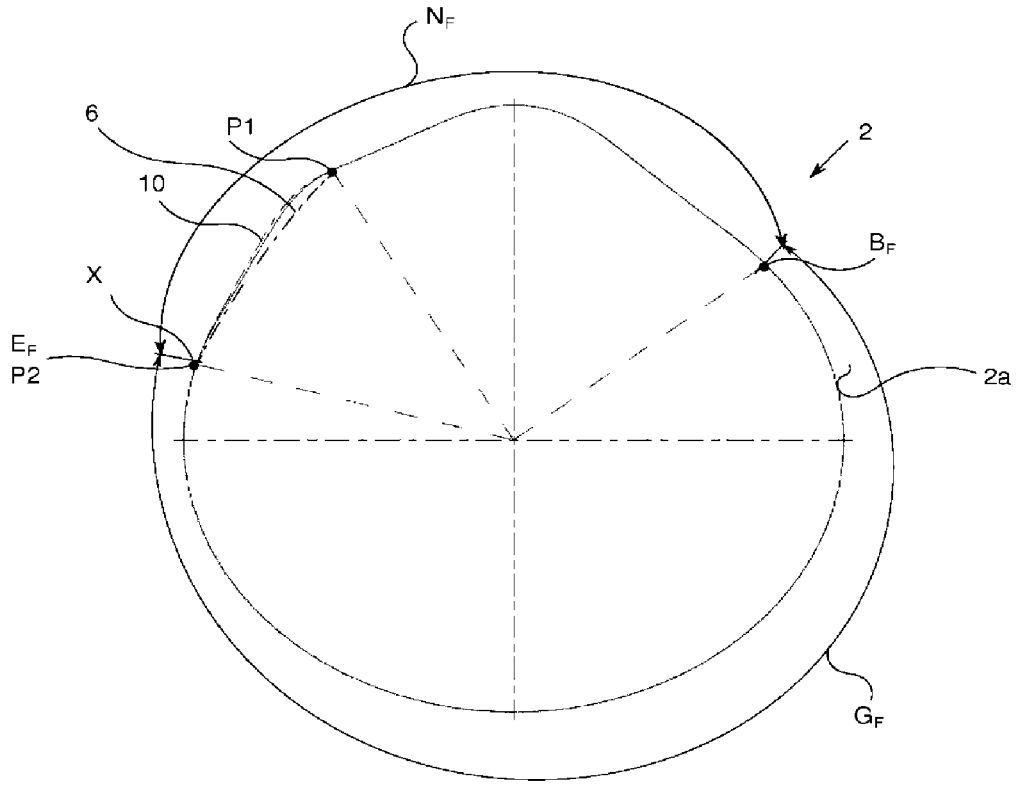
FIG. 4 is a side view of an example fixed cam element of a camshaft.

FIG. 4 schematically shows a lateral view of an embodiment of a fixed cam element 2 of a camshaft (not shown here) according to the invention. The fixed cam element 2 comprises, when viewed in the circumferential direction, a fixed cam base circle $G_F$ and a fixed cam elevation $N_F$. The fixed cam base circle $G_F$ extends in this case, advantageously, between an end or an end point of the fixed cam elevation $N_F$ and a beginning or a starting point of the fixed cam elevation $B_F$, wherein, in the basically-known cam elements 20 or 30 shown in FIGS. 1 through 3, at least no first transition point P1 and/or second transition point P2 for transferring a tapping element (not shown here) from the fixed cam element 2 to an adjustment cam element 3, as shown schematically in the following FIG. 5, or from the adjustment cam element 3 to the fixed cam element 2, is formed in the entire segment of the fixed cam base circle $G_F$. At least the first transition point P1 and/or at least the second transition point P2 is/are partially located in the segment of the fixed cam elevation $N_F$, which is adjacent to the segment of the fixed cam base circle $G_F$ and completes the circumference of the fixed cam element 2.

Figure 5:
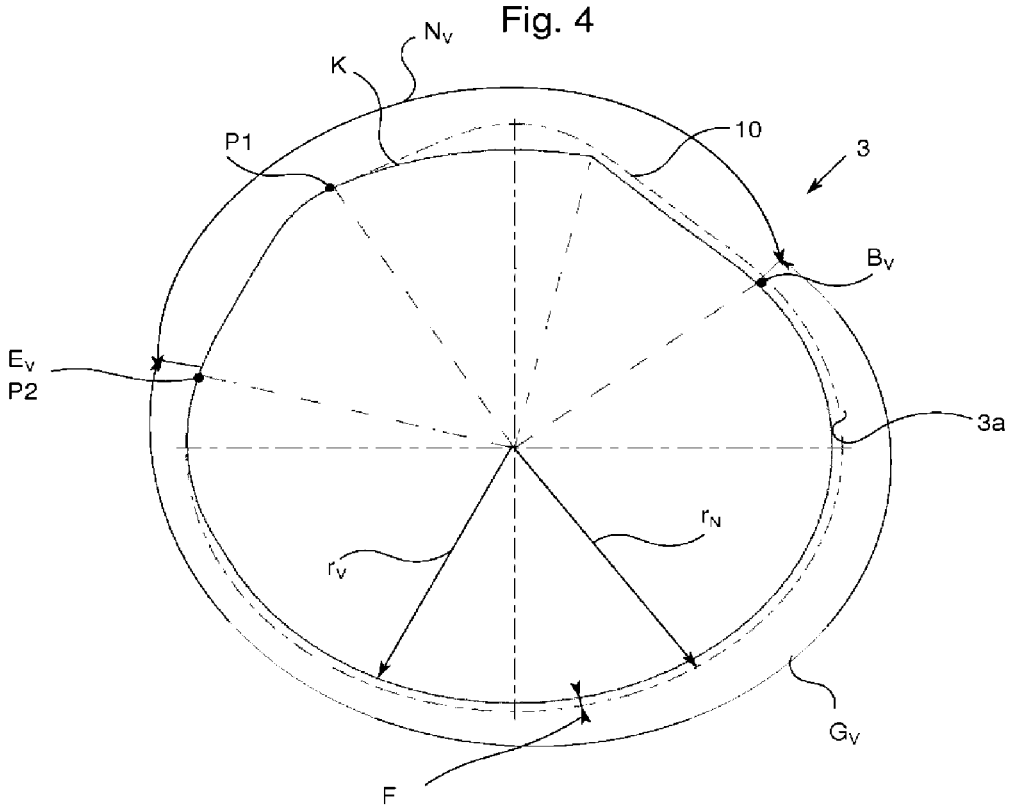
FIG. 5 is a side view of an example adjustment cam element of a camshaft.

With reference symbol 10 is illustrated a nominal cam contour for the entire cam pack 1 (cf., for example, FIGS. 8 through 11), with respect to which the design and shaping of the contours 2*a*, 3*a* of the individual cam elements 2 and 3 can be illustrated in FIGS. 4 and 5. Within the scope of the invention, the nominal cam contour is an idealized cam contour.

FIG. 4 also schematically shows a processing segment 6, by means of which the segment of the change in the fixed cam contour 2*a* is schematically specified in a region of the fixed cam element 2 between a first transition point P1 and a processing point X. The processing segment 6 extends, advantageously, starting from the first transition point P1 to the processing point X, which is formed either in the segment of the fixed cam elevation $N_F$ or, at least partially, in the segment of the fixed cam base circle $G_F$—consequently, essentially between the segment of the fixed cam elevation $N_F$ and the segment of the fixed cam base circle $G_F$. According to the method according to the invention, the fixed cam contour 2*a* is processed such that the region of the fixed cam elevation $N_F$ is expanded into the region of the fixed cam base circle $G_F$, in comparison to the design of the cam contour of basically-known fixed cam elements (cf. FIGS. 1 through 3), whereby the length of the fixed cam base circle $G_F$ is consequently reduced.

As shown in FIG. 4, the first transition point P1 is formed between the region of the fixed cam element 2 in which the beginning of the fixed cam elevation $B_F$ is formed and the region in which the end of the fixed cam elevation $E_F$ is formed. Within the scope of the invention, the first transition point P1 is consequently the region or segment of the fixed cam elevation $N_F$, or also of the adjustment cam elevation $N_V$, as shown, for example, in FIG. 5, where the tapping element is transferred from the fixed cam contour 2*a* to the adjustment cam contour 3*a* and consequently from the fixed cam element 2 to the adjustment cam element 3.

As, for example, shown in FIG. 4, the second transition point P2 is formed in the region of the end of the fixed cam elevation $E_F$ and can, consequently, advantageously be formed directly on the border region between the segment of the fixed cam elevation $N_F$ and the segment of the fixed cam base circle $G_F$, or directly on the segment of the fixed cam elevation $N_F$, or directly on the segment of the fixed cam base circle $G_F$.

The transition points P1 and P2 are not points or regions that can be directly assigned to a cam element 2 or 3, but, rather, are formed as a result of the interaction of the two cam elements 2 and 3. When viewing the adjustment cam element 3, the transition points P1 and P2 can consequently also be specified as reference points for the description of the positioning of the individual design features of the adjustment cam element 3.

The transition points P1 and P2 are, therefore, also shown in FIGS. 8 through 11.

FIG. 5 shows a lateral view of an embodiment of an adjustment cam element 3, which, comparably to the fixed cam element 2, also has a base circle, viz., the adjustment can base circle $G_V$, and a cam elevation, viz., the adjustment cam elevation $N_V$. With respect to the design and arrangement of the adjustment cam base circle $G_V$ and the adjustment cam elevation $N_V$, reference is made to the explanations listed above regarding the fixed cam element 2, which explanations also apply to the adjustment cam element 3. The same also applies to the arrangement of the first transition point P1, as well as of the second transition point P2.

As shown in FIG. 5, the adjustment cam contour 3*a* is designed such that the radius of the adjustment cam base circle $r_V$, and consequently also the respective diameter, is dimensioned to be smaller than the radius of the nominal base circle $r_N$, and consequently also the respective diameter, of the nominal cam contour 10. Formed as a result is a recess F, by means of which it is made possible that the tapping element (not shown here) contact the fixed cam contour 2*a* in the fixed cam base circle region $G_F$, as shown in FIG. 4, and not the adjustment cam contour 3*a* in the adjustment cam base circle $G_V$, when the cam contour 2*a* is traversed in the region of the base circle of the cam pack 1.

The region of a cam elevation designed to be constant is denoted by reference symbol K in FIG. 5. This constant cam elevation K is, advantageously, formed at the adjustment cam contour 3*a* and is characterized by a segment in the region of the adjustment cam elevation $N_V$, which has no—or only a negligibly small—positive and/or negative slope. Advantageously, the constant cam elevation K—in particular, the constant adjustment cam elevation K—is advantageously formed in the region of the first transition point P1 in the segment of the adjustment cam elevation $N_V$ and accordingly extends, advantageously, at least in sections between the point $B_V$, which marks the beginning of the adjustment cam elevation $N_V$, and the region of the first transition point P1. Particularly advantageously, the first transition point P1 is formed on the segment of the constant adjustment cam elevation, which segment extends in the circumferential direction of the adjustment cam element 3, so that, taking into consideration a desired adjustment angle between the adjustment cam element 3 and the fixed cam element 2, a coincidence of the fixed cam contour 2*a* and the adjustment cam contour 3*a* is ensured, in order to avoid profile jumps and allow for a trouble-free transition of the tapping element from the fixed cam element 2 to the adjustment cam element 3.

Figure 6:
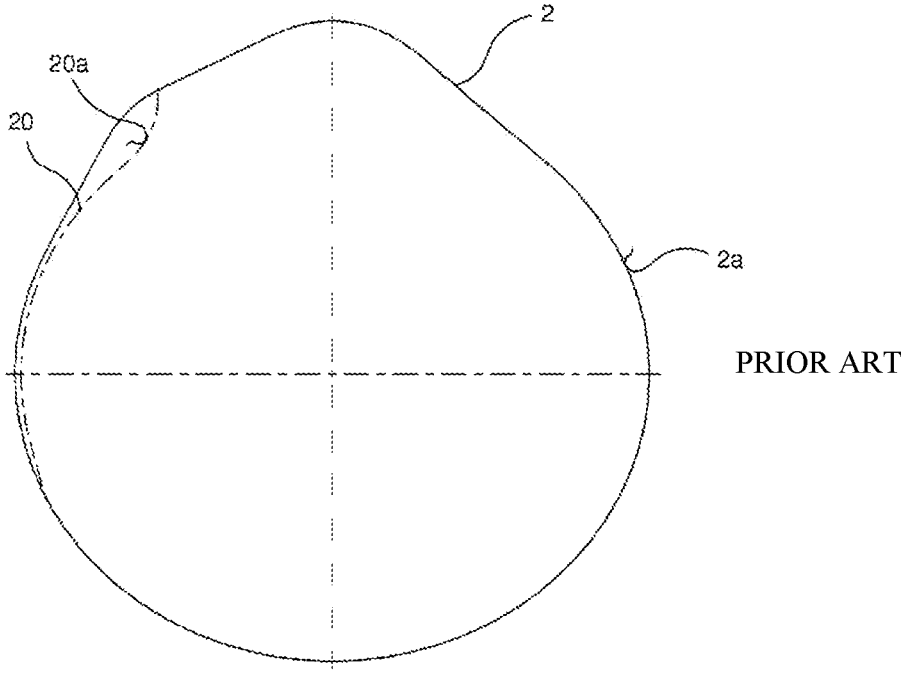
FIG. 6 is a side view of a prior art fixed cam element in comparison with an example fixed cam element with changed fixed cam contour of the present disclosure.

FIG. 6 shows a lateral view of a fixed cam element 20 known from the prior art in comparison to an embodiment of a fixed cam element 2 with the fixed cam contour 2*a* according to the present invention, which fixed cam contour is changed in comparison to the fixed cam contour 20*a* of the known fixed cam element 20. Advantageously, in the production of the new fixed cam contour 2*a*, a continuous transition region between the transition points (cf., for example, FIG. 4) is created by means of an advantageously constant reduction of the fixed cam contour protrusion or the fixed cam contour elevation in this named region. The processing of the fixed cam 2 takes place, in particular, taking into consideration the required edge conditions, such as the required valve velocities and accelerations, etc. The production of a recess, as the known fixed cam contour 20*a* (cf. FIG. 4) has, is advantageously avoided. Particularly advantageously, the entire fixed cam contour 2*a* of the fixed cam element 2 is produced—in particular, ground—circumferentially, after mounting of the fixed cam element 2 on the outer shaft of the camshaft (as shown, for example, in FIGS. 12 and 13).

Figure 7:
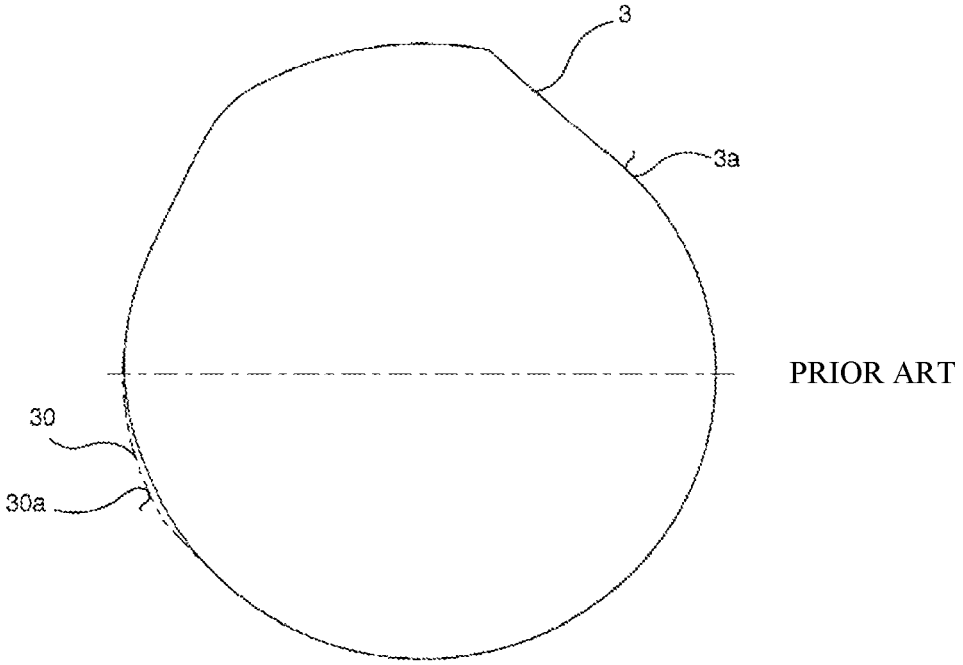
FIG. 7 is a side view of a prior art adjustment cam element in comparison with an example adjustment cam element with changed adjustment cam contour of the present disclosure.

Comparably to FIG. 6, FIG. 7 shows a lateral view of an adjustment cam element 30 known from the prior art in comparison to an embodiment of an adjustment cam element 3 with the adjustment cam contour 3*a* according to the present invention, which adjustment cam contour is changed in comparison to the known adjustment cam contour 30*a*. The processing or production of the adjustment cam contour 3*a* advantageously takes place prior to the mounting of the adjustment cam element 3 on the outer shaft of the camshaft (as shown, for example, in FIGS. 12 and 13). Advantageously, the adjustment cam elevation $N_V$ (cf. FIG. 5) of the adjustment cam element 3 is extended by a defined angular range, whereby the base circle diameter, in turn, is, essentially, continuously reduced. In the processing of the adjustment cam profile 3*a*, and consequently in the processing of the adjustment cam base circle $G_V$ or its tapering off, the required edge conditions, such as the valve velocity and the accelerations, etc., must be taken into consideration.

Based upon the changed cam contours 2*a* and 3*a* of the fixed cam element 2 and the adjustment cam element 3 respectively, jumps in the profile of the cam pack, which is composed of at least one fixed cam element 2 and one adjustment cam element 3, are, advantageously, avoided. Particularly advantageously, the fixed cam contour 2*a* and/or the adjustment cam contour 3*a*, and consequently the cam profile of the cam pack 1, are, advantageously, ground circumferentially, after the mounting of the cam on the shaft.

Figure 8:
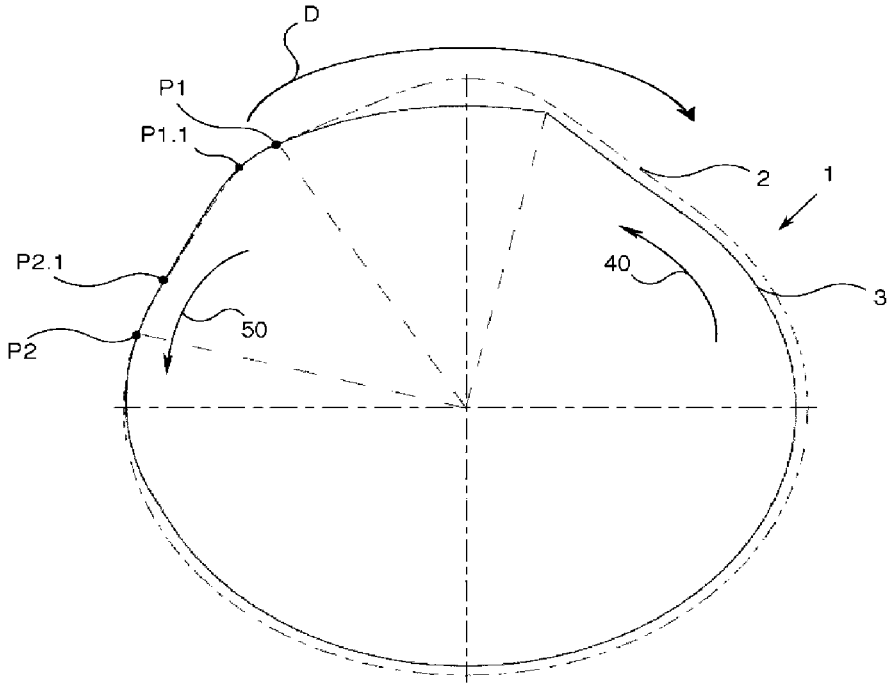
FIG. 8 is a side view of an example cam pack of a camshaft with a 0° spread between a fixed cam element produced at the upper tolerance limit and an adjustment cam element produced at the lower tolerance limit.
Figure 9:
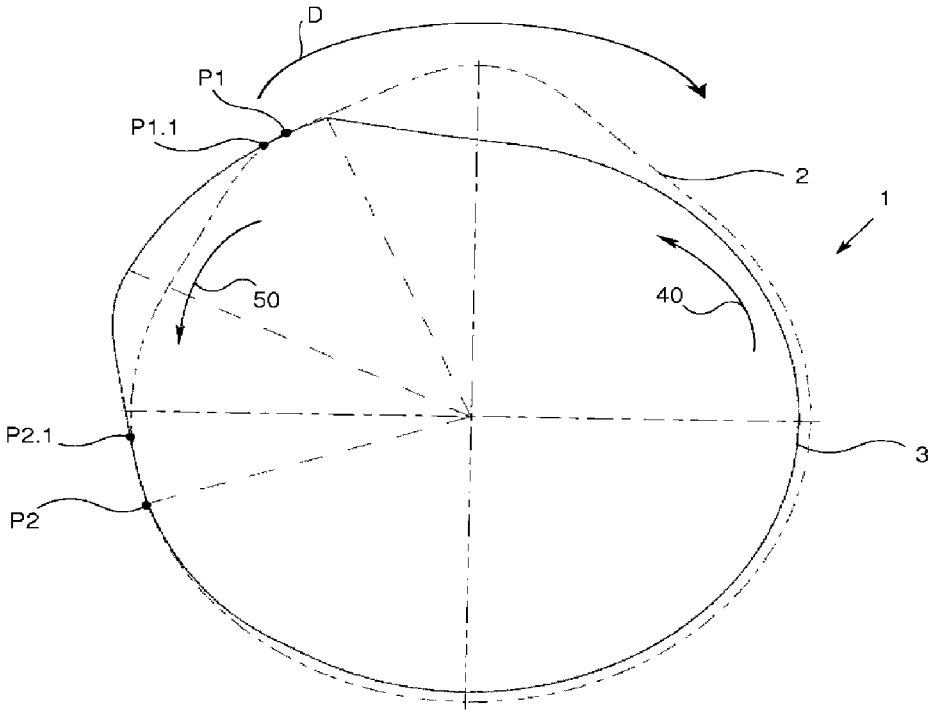
FIG. 9 is a side view of the example shown in FIG. 8 of a cam pack of a camshaft with a maximum spread between a fixed cam element produced at an upper tolerance limit and an adjustment cam element produced at a lower tolerance limit.

FIGS. 8 and 9 respectively show a lateral view of an embodiment of a cam pack 1, wherein the fixed cam element 2 is produced at the upper tolerance limit, and the adjustment cam element 3 is produced at the lower tolerance limit.

In the illustration shown in FIG. 8, a 0° spread between the adjustment cam element 3 and the fixed cam element 2 is shown, according to which the cam pack 1 is in a first extreme position. In contrast, in FIG. 9, a maximum spread between the adjustment cam element 3 and the fixed cam element 2 is shown, according to which the cam pack 1 is in a second extreme position. In this case, the superposition of the contours 2*a* and 3*a* of the individual cam elements 2 and 3 of the camshaft 100 according to the invention (cf. FIGS. 12 and 13) are consequently shown.

Independently of the desired adjustment angle of the camshaft (not shown here), and consequently of the spread of the cam pack 1, the design of the adjustment cam contour 3*a* and of the fixed cam contour 2*a* as described above results in an overlap in the regions of the transition points P1 and P2, such that jumps between the individual contours of the adjustment cam element 3 and the fixed cam element 2 are avoided in these regions, and an even cam profile with respect to the cam pack 1 consequently arises. Even a production of the cam elements 2 or 3 at the upper or lower tolerance limit does not have any negative influence upon the properties of the transition regions of the profile in the implementation of the method according to the invention. Thus, FIGS. 8 and 9 show that, based upon the use of the tolerance ranges in the production of the individual cam elements 2 or 3, the functional area of the adjustment cam element 3 is indeed reduced, because the actually used transition points P1.1 and P2.1 are respectively shifted in the direction of the other transition point P1 or P2 in comparison to the theoretical or calculated transition points P1 and P2. Nonetheless, a profile free of jumps is also obtained in this case. P1.1 is, consequently, the first actual transition point, where the tapping element is transferred from the fixed cam contour 2*a* to the adjustment cam contour 3*a*. Accordingly, the tapping element is transferred from the adjustment cam contour 3*a* to the fixed cam contour 2*a* at the second actual transition point P2.1.

Denoted by the reference symbol D is the direction of rotation of the entire cam pack 1, which is rotated about its axis of rotation A (cf. FIGS. 12 and 13), based upon the rotation of the entire camshaft (not shown here). The leading flank 40 of the cam pack 1 is therefore formed between the beginning of the respective cam elevation, viz., the adjustment cam elevation $B_V$ or the fixed cam elevation $B_F$, and an elevation peak, where the cam elevation has a maximum. Adjacent thereto is the trailing flank 50, which consequently extends starting from the elevation peak in the direction of the end of the cam elevation, viz., the adjustment cam elevation $E_V$ or the fixed cam elevation $E_F$. Such explanations also apply to the illustrations in FIGS. 10 and 11.

Figure 10:
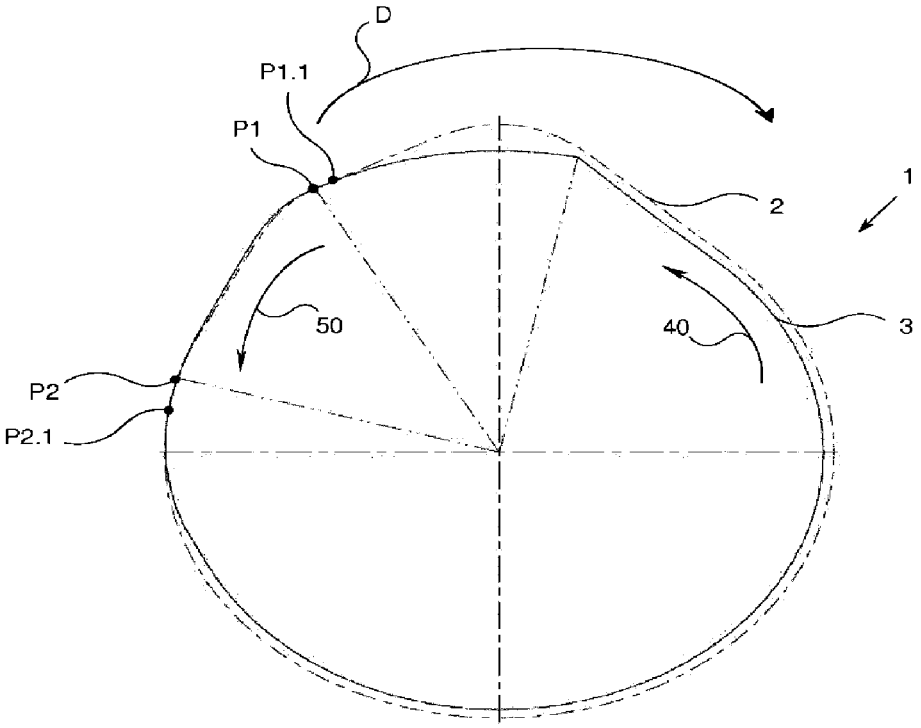
FIG. 10 is a side view of an example cam pack with a 0° spread between a fixed cam element produced at a lower tolerance limit and an adjustment cam element produced at an upper tolerance limit.
Figure 11:
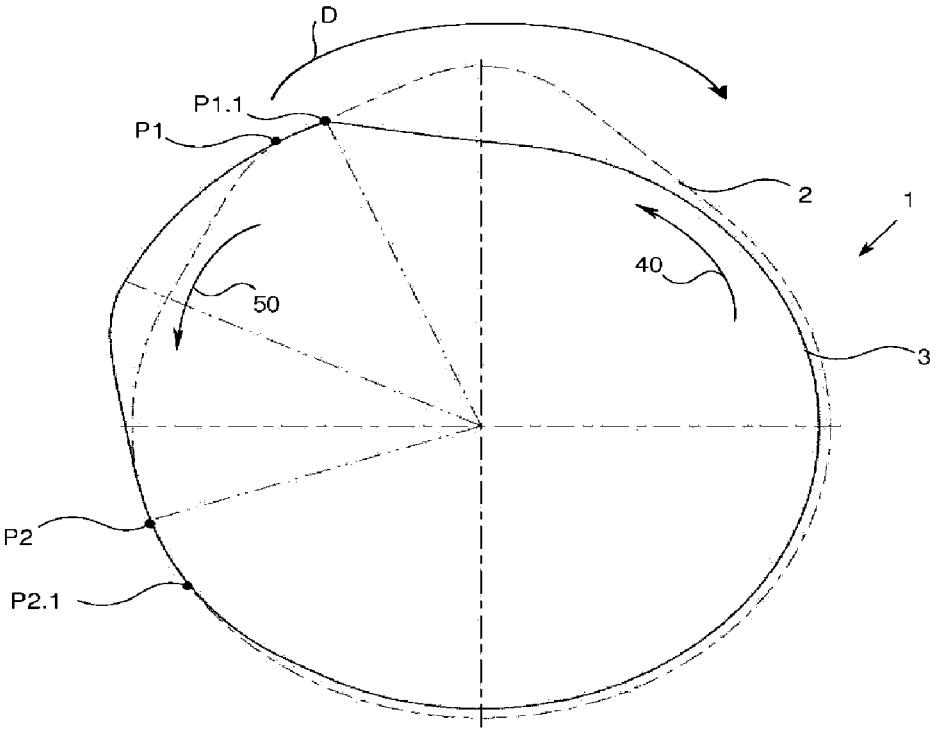
FIG. 11 is a side view of the example shown in FIG. 10 of a cam pack with a maximum spread between a fixed cam element produced at a lower tolerance limit and an adjustment cam element produced at an upper tolerance limit.

FIGS. 10 and 11 respectively show a lateral view of an embodiment of a cam pack 1, wherein the fixed cam element 2 is produced at the lower tolerance limit, and the adjustment cam element 3 is produced at the upper tolerance limit.

In the illustration shown in FIG. 10, a 0° spread between the adjustment cam element 3 and the fixed cam element 2 is shown, according to which the cam pack 1 is in a first extreme position. In contrast, in FIG. 11, a maximum spread between the adjustment cam element 3 and the fixed cam element 2 is shown, according to which the cam pack 1 is in a second extreme position. In this case, the superposition of the contours 2*a*, 3*a* of the individual cam elements 2, 3 of the camshaft 100 according to the invention (cf. FIGS. 12 and 13) is consequently shown.

Independently of the desired adjustment angle of the camshaft (not shown here), and consequently of the spread of the cam pack 1, the design of the adjustment cam contour 3*a* and of the fixed cam contour 2*a* as described above results in an overlap in the regions of the transition points P1 and P2, such that jumps between the individual contours of the adjustment cam element 3 and the fixed cam element 2 are avoided in these regions, and an even cam profile with respect to the cam pack 1 consequently arises. Even a production of the cam elements at the upper or lower tolerance limit does not have any negative influence upon the properties of the transition regions of the profile. Thus, FIGS. 10 and 11 show that, based upon the use of the tolerance ranges in the production of the individual cam elements 2 or 3, the functional area of the adjustment cam element 3 is indeed enlarged, because the actually used transition points P1.1 and P2.1 are respectively shifted in the direction of the base circle region, in comparison to the theoretical or calculated transition points P1 and P2. Nonetheless, a profile free of jumps is also obtained in this case. P1.1 is, consequently, the first actual transition point, where the tapping element is transferred from the fixed cam contour 2*a* to the adjustment cam contour 3*a*. Accordingly, the tapping element is transferred from the adjustment cam contour 3*a* to the fixed cam contour 2*a* at the second actual transition point P2.1.

Figure 12:
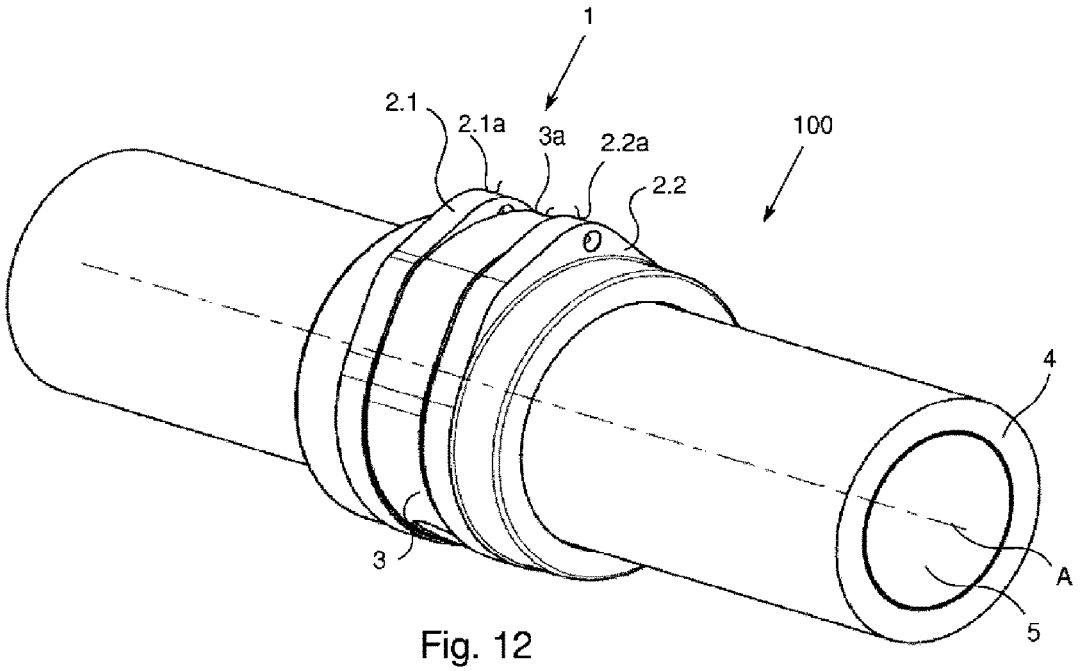
FIG. 12 is a perspective view of an example camshaft with a cam pack at 0° spread.
Figure 13:
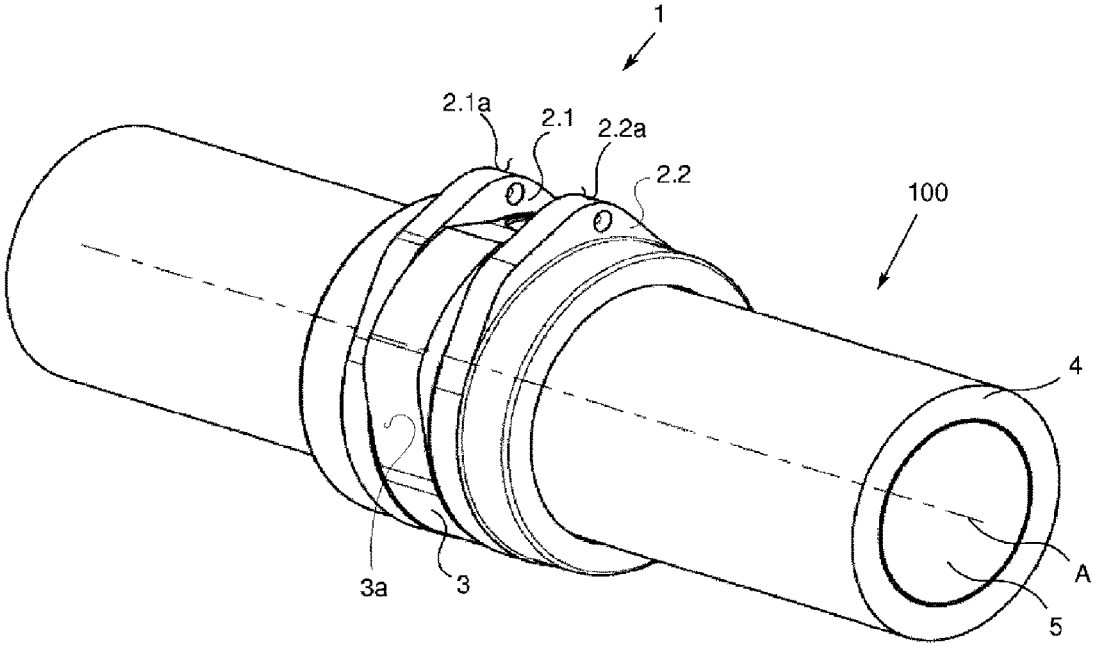
FIG. 13 is a perspective view of the example shown in FIG. 12 of a camshaft with a cam pack at maximum spread.

FIGS. 12 and 13 respectively illustrate a perspectival view of an embodiment of a camshaft 100 according to the invention with a cam pack 1, wherein the cam pack 1 is at a 0° spread according to FIG. 12, while the cam pack 1 according to FIG. 13 is positioned in a maximum spread.

The cam pack 1 comprises an adjustment cam element 3 and two fixed cam elements 2.1 and 2.2, which are arranged adjacently to the adjustment cam element 3 and in a manner enframing it between them. The fixed cam elements 2.1 and 2.2, as well as the adjustment cam element 3, have a common axis of rotation A and are advantageously arranged coaxially to each other.

Based upon the spread of the cam pack 1, i.e., as a result of the angular position of the adjustment cam element 3 in relation to the fixed cam elements 2.1 and 2.2, a variability in the valve elevation, and thus in the opening period of the control valve, of a combustion engine is, advantageously, made possible. The advantageously stepless opening period of the cam profile, which consists of the adjustment cam contour 3*a* and the respective fixed cam contours 2.1*a* and 2.2*a* of the fixed cam elements 2.1 and 2.2, is caused in this case by the spread of the cam pack 1 by, for example, a relative rotation of the inner shaft 5 in relation to the outer shaft 4. A rotation—in particular, the realization of an adjustment angle between the fixed cam elements 2.1, 2.2 and the adjustment cam element 3—advantageously takes place as a result of the arrangement of the adjustment cam element 3 on the inner shaft 5 for conjoint rotation and the arrangement of the fixed cam elements 2.1, 2.2 on the outer shaft 4 for conjoint rotation.

The described embodiments do not presuppose completeness. It is, furthermore, conceivable that the features described in the figures also be used in combination with each other.

LIST OF REFERENCE SYMBOLS

1 Cam pack
2 Fixed cam element
2*a* Fixed cam contour
2.1 First fixed cam element
2.1*a* Fixed cam contour of the first fixed cam element
2.2 Second fixed cam element
2.2*a* Fixed cam contour of the second fixed cam element
3 Adjustment cam element
3*a* Adjustment cam contour
4 Outer shaft
5 Inner shaft
6 Processing segment
10 Nominal cam contour
11 Cam pack (prior art)
20 Fixed cam element (prior art)
20*a* Fixed cam contour (prior art)
21 Recess of the fixed cam element
30 Adjustment cam element (prior art)
30*a* Adjustment cam contour (prior art)
40 Leading flank
50 Trailing flank
100 Camshaft
A Axis of rotation
$B_F$ Beginning of the fixed cam elevation
$B_V$ Beginning of the adjustment cam elevation
D Direction of rotation
$E_F$ End of the fixed cam elevation
$E_V$ End of the adjustment cam elevation
F Recess
$G_F$ Fixed cam base circle
$G_V$ Adjustment cam base circle
K Constant cam elevation
$N_F$ Fixed cam elevation
$N_V$ Adjustment cam elevation
P1 First transition point (theoretical)
P1.1 First actual transition point
P2 Second transition point (theoretical)
P2.1 Second actual transition point
$r_F$ Radius of the fixed cam base circle
$r_V$ Radius of the adjustment cam base circle
X Processing point

What is claimed is:

1. A method for producing a cam profile of a cam pack of a camshaft, wherein the cam pack includes at least two cam elements that are adjustable relative to each other, wherein the camshaft comprises an inner shaft disposed concentrically within an outer shaft such that the inner shaft is rotatable, wherein the at least two cam elements include a fixed cam element connected to the outer shaft for conjoint rotation and an adjustment cam element connected to the inner shaft for conjoint rotation, the method comprising:

processing an adjustment cam contour of the adjustment cam element by way of a continuous diameter reduction of a segment of an adjustment cam base circle, wherein the adjustment cam base circle is reduced to a diameter smaller than a fixed cam nominal circle diameter minus a doubled adjustment cam base circle tolerance; and processing a fixed cam contour of the fixed cam element by reducing a fixed cam contour protrusion in a region between a transition point and a processing point, wherein upon reaching the transition point a tapping element for converting a revolving motion of the at least two cam elements into a linear motion of valve pistons is transferred from the fixed cam element to the adjustment cam element.

2. The method of claim 1 wherein the processing of the adjustment cam contour is performed by way of a grinding process.

3. The method of claim 1 wherein the processing of the fixed cam contour is performed by way of a grinding process.

4. The method of claim 1 wherein at the transition point the fixed cam contour is configured as a constant cam elevation.

5. The method of claim 1 wherein the adjustment cam contour in the adjustment cam base circle is reduced at least in sections by about 0.02 mm per about 5° cam angle.

6. The method of claim 1 further comprising producing a recess at least in sections in the adjustment cam base circle, wherein the recess is reduced relative to a fixed cam base circle at least by about a doubled profile tolerance of the adjustment cam base circle.

* * * * *